US006098824A

United States Patent [19]

Krebs et al.

[11] Patent Number: 6,098,824

[45] Date of Patent: Aug. 8, 2000

[54] TELESCOPIC CRANE BOOM SECTION AND A PROCESS FOR MAKING SURE

[75] Inventors: Thomas Krebs, Blieskastel; Michael Irsch, Lebach; Karl-Heinz Rube, Zweibrücken, all of Germany

[73] Assignee: Mannesmann AG, Düsseldorf, Germany

[21] Appl. No.: 09/041,345

[22] Filed: Mar. 12, 1998

[30] Foreign Application Priority Data

Mar. 12, 1997 [DE] Germany ..... 197 11 975

[51] Int. Cl.[7] ..... B66C 23/04

[52] U.S. Cl. ..... 212/347; 52/118

[58] Field of Search ..... 212/347, 348, 212/349, 350; 52/118

[56] References Cited

U.S. PATENT DOCUMENTS

| | | | |
|---|---|---|---|
| 3,931,698 | 1/1976 | Ebersold | 212/350 |
| 4,016,688 | 4/1977 | Tiffin et al. | 212/350 |
| 4,337,601 | 7/1982 | Vaerk et al. | 52/118 |
| 5,628,416 | 5/1997 | Frommelt et al. | 212/292 |
| 5,865,328 | 2/1999 | Kaspar | 212/350 |
| 5,884,791 | 3/1999 | Vohdin et al. | 212/348 |

FOREIGN PATENT DOCUMENTS

| | | | |
|---|---|---|---|
| 49 92 08 | 6/1995 | European Pat. Off. . | |
| 58 35 52 | 8/1995 | European Pat. Off. . | |
| 66 82 38 | 8/1995 | European Pat. Off. . | |
| 3015599 | 10/1981 | Germany | 212/350 |
| 2317595 | 10/1994 | Germany | 212/350 |

*Primary Examiner*—Thomas J. Brahan

*Attorney, Agent, or Firm*—Cohen, Pontani, Lieberman & Pavane

[57] ABSTRACT

A telescopic boom section for a mobile crane including an upper inverted U-shaped longitudinal section and a lower convexo-concave longitudinal section. The upper section and the lower section are welded to each other along the seams formed by the longitudinal edges of the upper and the lower sections such that the concave surface of the lower section and the U-shaped wall of the upper section defines a cavity therewithin. The lower section includes a plurality of arcuate segments disposed sequentially across the concave surface and which are formed by a cold roll die.

10 Claims, 5 Drawing Sheets

TELESCOPIC CRANE BOOM SECTION AND A PROCESS FOR MAKING SURE

BACKGROUND OF THE INVENTION

1. Field of the Invention

The present invention relates to telescopic crane booms for mobile cranes, and more particularly, a hollow telescopic crane boom whose cross section includes an inverted U-shaped section and a convexo-concave section.

2. Description of the Related Art

Mobile cranes have telescopic booms which can handle heavy loads and can be extended to great heights. Although the load handling capability of a telescopic boom can be increased by simply increasing its size or bulk, such design solution is often undesirable as it entails a corresponding increase in the size and weight of the drive motor and mechanism of the mobile crane. Furthermore, state highway regulations require permits for operating vehicles, such as mobile cranes, whose weight exceeds a specified limit.

Prior art telescopic boom designs achieve good strength to weight ratios by employing hollow boom sections with rectangular, trapezoidal or triangular cross sections. Typically, these cross sections are made from structural steel plates having thickness of at least about 3/16 of an inch so that the boom would not easily buckle and become plastically deformed. To further increase the strength of these booms, stiffeners are added to the side walls of the booms so as to increase the shear carrying capacity of the side walls. These known boom sections are inexpensive to produce and are adequate for smaller cranes.

Another prior art telescopic boom is known from European Publication EP 0 499 208 B1. This European publication discloses a hollow boom cross section formed by an inverted U-shaped longitudinal section and a semi-circular or semi-elliptical longitudinal section. The inverted U-shaped section and the semi-circular section are welded to each other along the seams formed by longitudinal edges of these sections. The telescopic boom is mounted on the mobile crane such that when the boom is in a horizontal position, the inverted U-shaped section is disposed atop the semi-circular section. So configured, the inverted U-shaped section of the boom would be subjected to tensile stresses while the semi-circular section would be subjected to compressive stresses during use. This telescoping boom has high buckling strength due to the special geometrical configuration of the semi-circular or semi-elliptical section. It is, however, expensive to produce due to its semi-circular or semi-elliptical configuration.

According to European Publication EP 0 583 552 B1, this disadvantage can be overcome by forming instead a trough-like section having a plurality of strips affixed at an oblique angle to each other. This trough-like section however, has lower buckling strength than that of the semi-circular section due to the placement of strips located at the bottom-most portion of the trough-like section. In addition, the contour of the bearing member for supporting the telescoping boom sections must be adjusted for the progression or the sliding action of the trough-like section.

Accordingly, there is a need for a telescopic boom which is simple and inexpensive to produce and which is geometrically configured to have high buckling strength suitable for use in large cranes. There is also a need for a telescopic boom with easily adjustable bearing members for supporting the boom sections.

SUMMARY OF THE INVENTION

The present invention provides a boom section with an upper inverted U-shaped section and a lower longitudinal section that is convexo-concave, i.e. convex on one side and concave on the other. The lower convexo-concave section may be manufactured with one or, at most, two dies, preferably cylindrical dies, which have different radii. The metal sheet to be deformed can be incrementally or sequentially moved past the die(s) at a speed optimized for the specific size of the cross-section of the boom section being produced. Thus, for example, for boom sections subject to high buckling load, the metal sheet should be fed slowly and incrementally in the forward direction so that the circular arc segments will overlap one another and merge into each other tangentially. For boom sections subject to low buckling load, the metal sheet may be fed at a higher speed.

According to another aspect of the invention, the convexo-concave lower section may include straight planar sections proximate the longitudinal edges of the convexo-concave section which can be merged tangentially with the side walls of the inverted U-shaped section. In addition, the convexo-concave section may also include substantially flat apex region.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
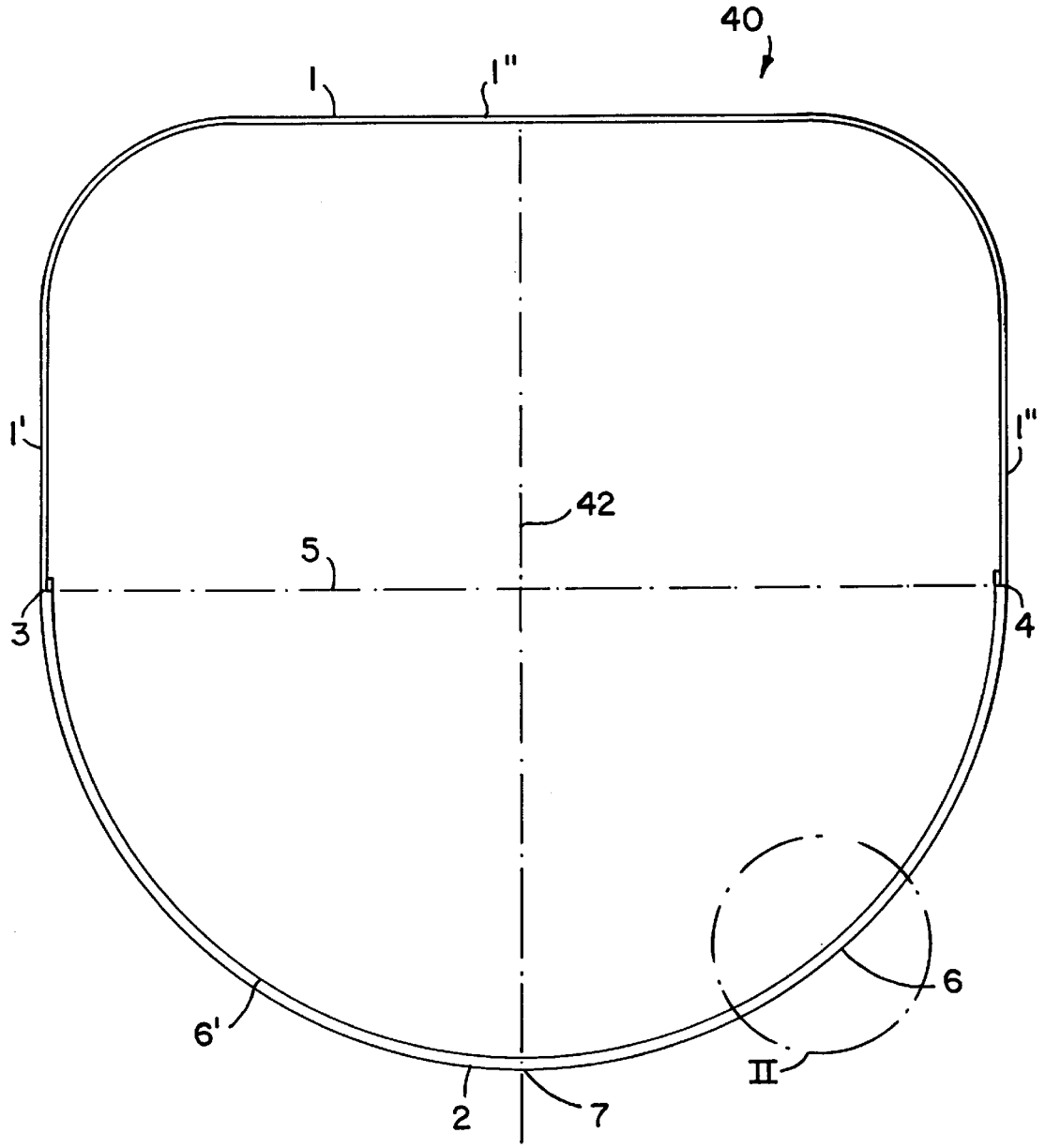
FIG. 1 depicts cross-sectionally an embodiment of the telescopic boom section in accordance with the present invention.

Referring initially to FIG. 1, there is shown a cross-section of an embodiment of the hollow telescopic boom section 40 of the present invention. The boom section 40 is a generic section of a telescopic boom in the sense that it may be employed as a base section disposed at the base of the telescopic crane boom (not shown), as a fly section disposed at the upper end of the crane boom, or as an intermediate section disposed between the base section and the fly section. As shown, the boom section 40 preferably includes an upper inverted approximately U-shaped longitudinal section 1 and a lower convexo-concave longitudinal section 2.

The upper inverted U-shaped section 1 has side walls 1' and 1" depending downwardly from opposite edges of top wall 1''' for attachment with corresponding longitudinal edges of the convexo-concave section 2. Preferably, the upper and lower sections 1 and 2 are joined together along longitudinal seams 3 and 4 by, for example, welding or riveting. Although it is shown that the length of side walls 1' and 1'' of inverted U-shaped section 1 is about one half the length of the assembled side walls of the assembled boom section 40, it is contemplated that the length of the side walls 1' and 1'' may be of any dimension so long as the side walls 1' and 1'' can carry the anticipated shear load without experiencing plastic deformation. For most applications, the wall thickness of the inverted U-shaped section 1 may be thinner than that of the convexo-concave section 2 and is preferably uniform throughout the cross-section. It is contemplated that the side walls 1' and 1'' may have a thickness greater than that of the top wall 1''' of inverted U-shaped section 1.

As depicted in FIG. 1 the upper section 1 and the lower convexo-concave longitudinal section 2 are preferably configured to be symmetrical about a longitudinal center plane 42 extending substantially halfway between the side walls of the boom section 40. The center plane 42 separates the convexo-concave section 2 into two longitudinal curved portions 6 and 6' of substantially the same size. The convexo-concave section 2 includes an apex region 7 disposed at and along the center plane 42. The portions 6 and 6' merge tangentially, i.e. the outside surfaces of portions 6 and 6' blend smoothly into each other in the bottom region 7 and the longitudinal edges of lower section 2 attach tangentially to corresponding edges of the side walls 1' and 1'' of the upper section 1 along a transition plane 5. Thus, the transition plane 5 defines the boundary where the upper and lower sections 1 and 2 meet.

Figure 2:
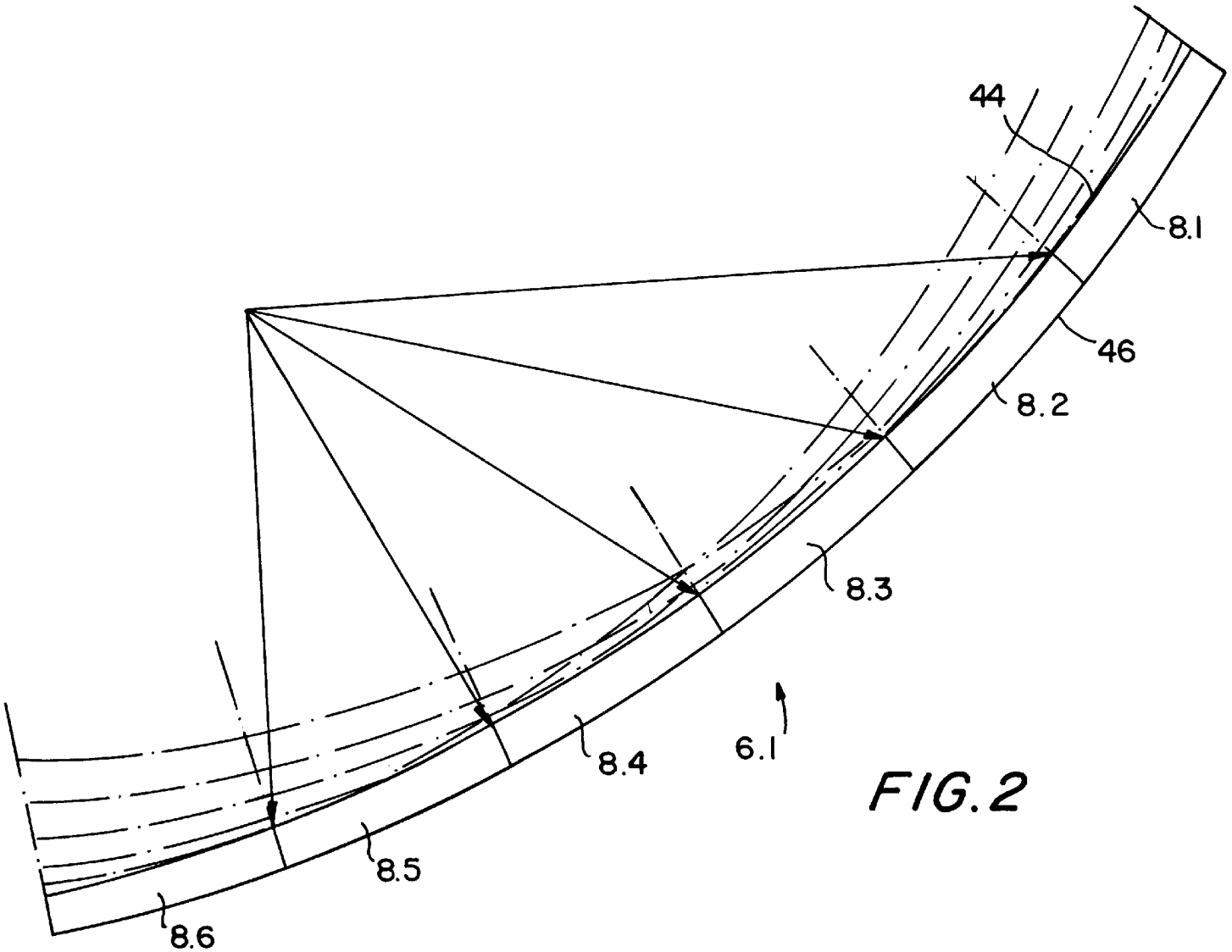
FIG. 2 is a detailed view of a portion of the cross-section of a variation of the embodiment of FIG. 1.

FIGS. 2 to and 4 show in detail a portion of the convexo-concave section 2, generally indicated as II in FIG. 1, having different variations of the embodiment of FIG. 1. Specifically, FIG. 2 depicts a preferred embodiment which provides the best structural performance. As shown, the convexo-concave section 2 comprises a plurality of arcuate segments 8.1 to 8.6 which are produced by slowly feeding a substantially flat metal sheet past a cold roll die (whose outline is shown generally by the dash-dot lines with each line indicating the location of the die relative to the metal sheet at an instant of time). The die sequentially cold rolls discrete arcuate segments on the metal sheet separated by a selected distance. The selected distance is preferably inversely proportional to the size of the overall cross section of the telescopic boom section. Furthermore, the selected distance has an annular range of about 5° to 30° as measured from a corresponding center of radius, as is readily understood by an ordinary artisan from the disclosure provided herein. As will be described below, the preselected distance is defined by substantially flat segments disposed between adjacent arcuate segments. Preferably, the arcuate segments 8.1–8.6 have substantially the same radii of curvature and that the radius of curvature of each arcuate segment is less than half the distance between the two longitudinal edges 3' and 4' of the lower section 2. As a result of the slow feeding movement of the metal sheet, adjacent arcuate segments such as, for example, 8.1 and 8.2, merge tangentially into each other thereby forming smooth inner and outer walls 44 and 46 which do not contain sharp edges or projections. Put in another way, the concave surface of the curved portion 6.1 forms a smooth continuous curve that is practically without any discontinuities.

Figure 3:
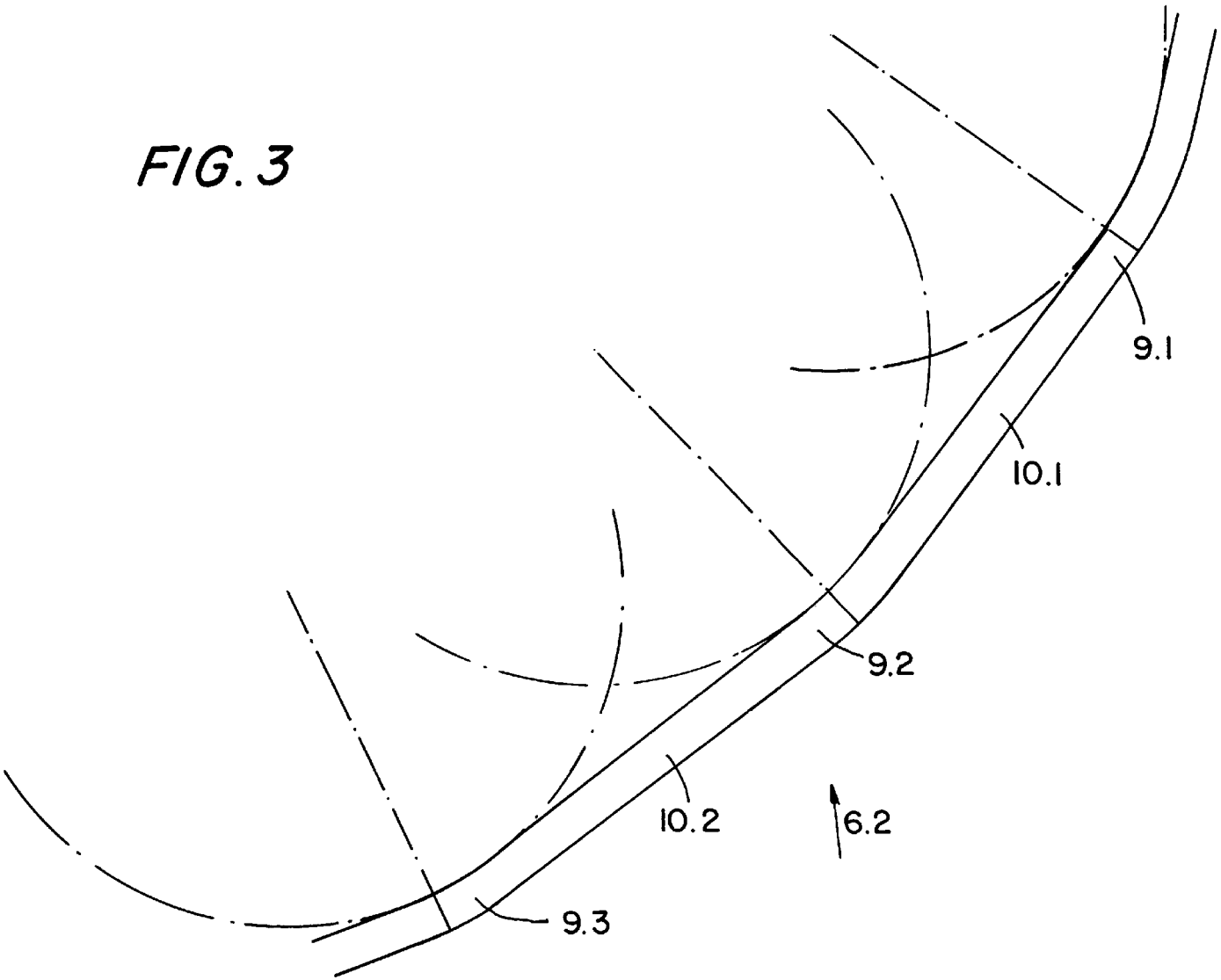
FIG. 3 is a detailed view of another variation of the embodiment of FIG. 1.

FIG. 3 schematically depicts in detail a curved portion 6.2 of a convexo-concave section 2 formed from a metal sheet that has been fed past the cold roll die at a speed much greater than that used for producing the embodiment of FIG. 2. As a result, the curved portion 6.2, in contrast to the curved portion 6.1 of FIG. 2, has substantially flat strip-like intermediate segments 10.1 and 10.2 disposed between arcuate segments 9.1–9.2 and 9.2–9.3, respectively.

The strip-like segments 10.1 and 10.2 are in fact arcuate segments which appear substantially flat because of their large or essentially infinite radii of curvature. This contour is produced when the forward movement of the metal sheet is great relative to the diameter of the cold roll die.

Figure 4:
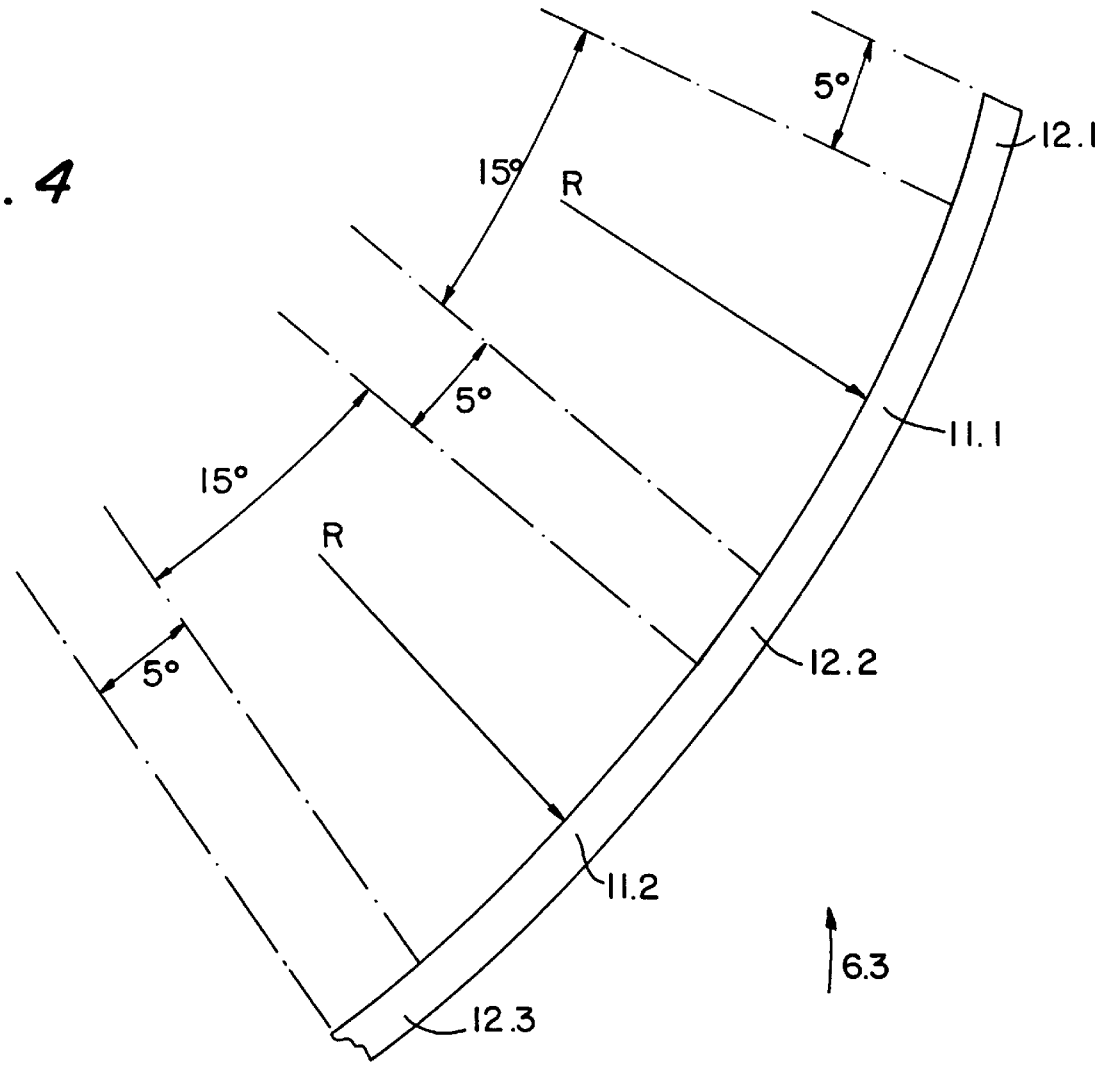
FIG. 4 is a detailed view of still another variation of the embodiment of FIG. 1.

FIG. 4 schematically illustrates a preferred embodiment of the convexo-concave section 2 that has been cold rolled at a moderate feeding speed. The contour of this curved portion 6.3 of the convexo-concave section includes overlapping arcuate segments. As shown, arcuate segments 11.1 and 11.2 are the areas of the metal sheet contacted directly by a cold roll die having a radius R. Each of the arcuate segments 11.1 and 11.2 extends angularly and circumferentially for a distance of about 15° as measured from a center of radius (not shown). The arcuate segments 11.1 and 11.2 are interposed between strip segments 12.1, 12.2 and 12.3 (extending approximately 5° along the circumference) which have not been worked or contacted by the cold roll die. One can readily see that as the length of segments 12.1, 12.2, and 12.3 decreases, the contour of the portion 6.3 approaches that of portion 6.1 of FIG. 2.

An advantage of the contour shown in FIG. 4 is that the curved portion 6.3 can be produced by adjusting the feeding speed of the metal sheet so that the contour of curved portion 6 is as close as possible to the embodiment shown in FIG. 2. As a result, high buckling strength is attained and the disadvantages associated with the bevelled strips as disclosed in EP 0583 552 B1 are avoided.

Figure 5:
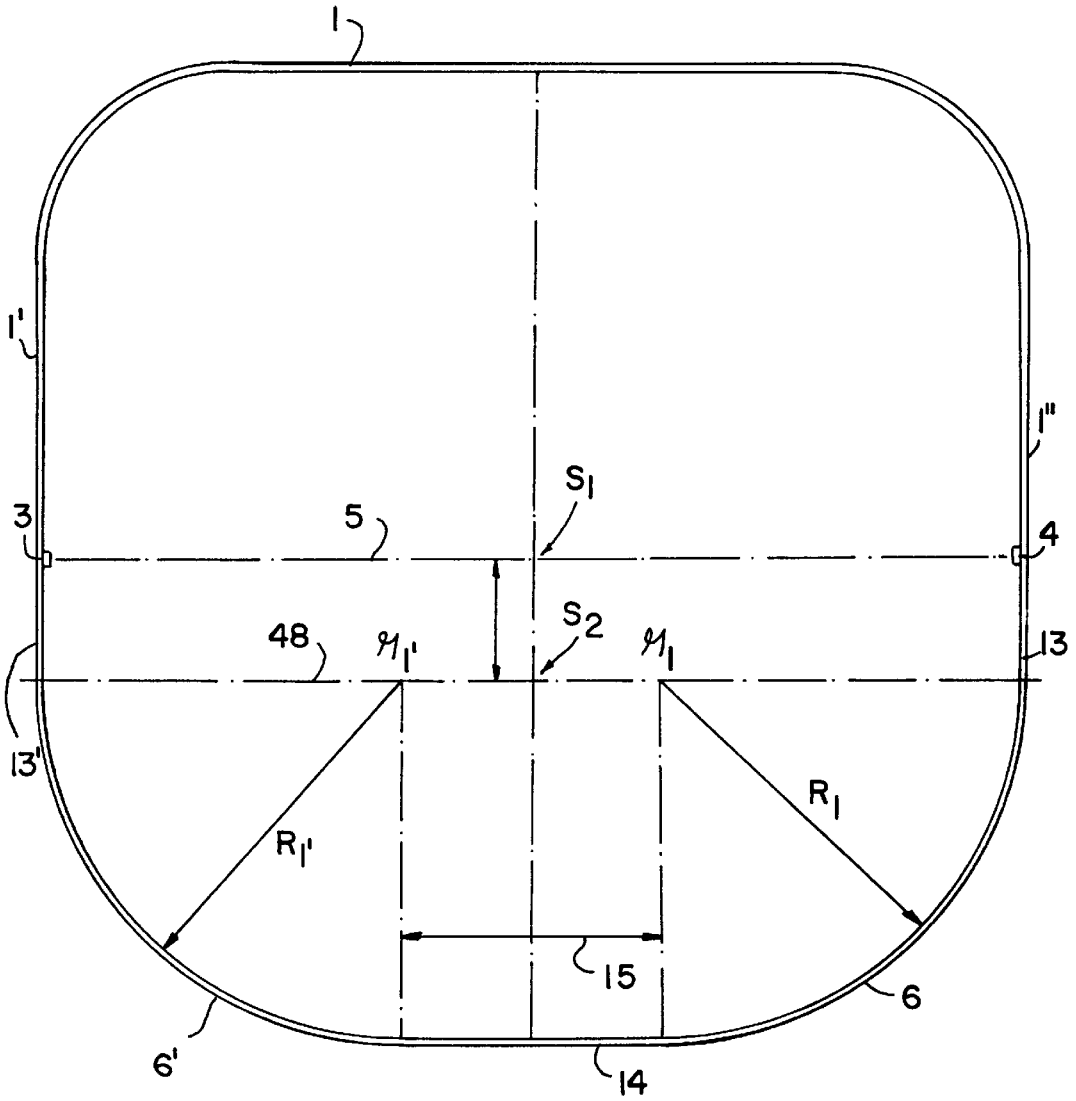
FIG. 5 depicts cross-sectionally another embodiment of the present invention.

FIG. 5 shows another embodiment of the telescopic boom in accordance with the present invention. In this embodiment, the curved portions 6 and 6' of the convexo-concave section 2 may be similarly configured as those shown in FIGS. 2–4. Furthermore, the convexo-concave section 2 includes straight side walls 13, 13' that extend from curved portions 6 and 6'. The side walls 13, 13' are connected to the corresponding side walls 1' and 1'' of the inverted U-shaped section 1 by welding together seams 3 and 4. A transverse flat section 14 having a width 15 is also provided in the bottom region 7. The width 15 is preferably in the range of about 1 to 100 mm but should not exceed 500 mm. It has been found that when the width 15 exceeds this preferred range, the buckling strength provided by the curved portions 6, 6' will be drastically reduced. As depicted, $S_1$ is the intersection between the longitudinal center plane 42 and transition plane 5. $S_2$ is the intersection between the longitudinal center plane 42 and another transition plane 48. The transition plane 48 defines the transition between the curved portions 6 and 6' and the straight portions 13 and 13' of the convexo-concave section 2. Radius $R_1$ extends from center $M_1'$ (disposed on the transition plane 48) to curved portion 6'. Similarly, radius $R_2$ extends from center $M_1$ (located on the transition plane 48) to curved portion 6.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A telescopic boom section for a crane, comprising:

an upper longitudinal section having a substantially flat top wall and two side walls extending longitudinally and downwardly from opposite edges of the top wall; and a lower longitudinal section having a convexo-concave wall, said wall having a convex exterior surface, a concave interior surface, a bottom region and two longitudinal edges, said two longitudinal edges of said lower longitudinal section being affixed to corresponding edges of said side walls of said upper longitudinal section such that the concave interior surface of said lower longitudinal section and said top and side walls of said upper longitudinal section define a cavity therewith, said lower longitudinal section including a series of arcuate segments having offset centers of radii, said series of arcuate segments being disposed adjacent one another and sequentially across the lower longitudinal section along a curved path to thereby form the concave interior surface of said convexo-concave wall.

2. The telescopic boom section of claim 1, wherein said upper and lower longitudinal sections are each symmetrical about a longitudinal center plane which bisects said upper and lower sections.

3. The telescopic boom section of claim 2, wherein said two longitudinal edges of said lower section extend linearly for a preselected distance along said center plane.

4. The telescopic boom section of claim 3, wherein said two longitudinal edges attach tangentially to corresponding edges of the side walls of said upper section.

5. The telescopic boom section of claim 1, wherein said arcuate segments have a substantially common radius of curvature and are merged tangentially into each other.

6. The telescopic boom section of claim 5, wherein the radius of curvature of each arcuate segment is less than half a distance between the two longitudinal edges of said lower longitudinal section.

7. The telescopic boom section of claim 1, wherein radii of curvature of said sequentially disposed arcuate segments alternate between a smaller and a larger value.

8. The telescoping boom section of claim 7, wherein said arcuate segment having a smaller radius of curvature extends angularly between about 5° and 30° as measured from a corresponding center of radius.

9. The telescopic boom section of claim 1, wherein said bottom region of said convexo-concave wall includes an essentially flat portion.

10. The telescopic boom section of claim 9, wherein said essentially flat portion of the bottom region has a width of not more than 500 mm in the transverse direction.

* * * * *

UNITED STATES PATENT AND TRADEMARK OFFICE

CERTIFICATE OF CORRECTION

PATENT NO. : [illegible]

DATED : [illegible]

INVENTOR(S) : [illegible]

It is certified that error appears in the above-identified patent and that said Letters Patent is hereby corrected as shown below:

In the title, please delete "SURE" and insert --CAD--.

Signed and Sealed this

Twenty-second Day of May, 2001

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,098,824
DATED : August 8, 2000
INVENTOR(S) : Krebs, Thomas; Irsch, Michael; and Rube, Karl-Heinz It is certified that error appears in the above-identified patent and that said Letters Patent is hereby corrected as shown below:

Title page,
Please delete "SURE" and insert -- SAME --.

This certificate supersedes certificate of correction issued May 22, 2001.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*